US007806055B2

(12) United States Patent
Michel

(10) Patent No.: US 7,806,055 B2
(45) Date of Patent: Oct. 5, 2010

(54) ROPE TRANSPORT INSTALLATION WITH GROUPING OF VEHICLES BEFORE LOADING/UNLOADING AND METHOD FOR CONTROLLING SUCH AN INSTALLATION

(75) Inventor: Daniel Michel, Proveysieux (FR)

(73) Assignee: Pomagalski SA, Fontaine (FR)

( * ) Notice: Subject to any disclaimer, the term of this patent is extended or adjusted under 35 U.S.C. 154(b) by 623 days.

(21) Appl. No.: 11/798,600

(22) Filed: May 15, 2007

(65) Prior Publication Data

US 2007/0284219 A1 Dec. 13, 2007

(30) Foreign Application Priority Data

Jun. 9, 2006 (FR) ..... 06 05131

(51) Int. Cl.
*B61B 7/00* (2006.01)

(52) U.S. Cl. ..... 104/173.1

(58) Field of Classification Search ..... 104/27, 104/28, 30, 87, 89, 112, 117, 117.1, 168, 104/173.1, 173.2, 178; 105/148, 149.1, 150
See application file for complete search history.

(56) References Cited

U.S. PATENT DOCUMENTS 3,431,866 A * 3/1969 Bouladon et al. ..... 104/25
4,509,430 A * 4/1985 Creissels ..... 104/173.1
4,712,486 A 12/1987 Tarassoff
4,744,306 A * 5/1988 Kunczynski ..... 104/168
4,843,968 A * 7/1989 Rikli ..... 104/27
5,253,589 A * 10/1993 Kawanishi et al. ..... 104/28
6,202,563 B1 3/2001 Tarassoff et al.

FOREIGN PATENT DOCUMENTS

EP 0 557 179 A1 8/1993
EP 0 922 620 A1 6/1999
FR 2 528 781 A1 12/1983
FR 2 583 363 A1 12/1986

* cited by examiner

*Primary Examiner*—S. Joseph Morano
*Assistant Examiner*—Robert J McCarry, Jr.
(74) *Attorney, Agent, or Firm*—Oliff & Berridge, PLC

(57) ABSTRACT

A transport installation comprising a continuous running rope supporting vehicles arranged at intervals along the rope with a preset running rate, comprises:

a vehicle grouping section, arranged between a slowing-down section and an intermediate section, equipped with means for forming groups of a preset number of vehicles, a vehicle separating section, arranged between the intermediate section and a speeding-up section, to collectively stock each group coming from the intermediate section.

The invention also relates to a method for controlling such an installation.

15 Claims, 6 Drawing Sheets

ROPE TRANSPORT INSTALLATION WITH GROUPING OF VEHICLES BEFORE LOADING/UNLOADING AND METHOD FOR CONTROLLING SUCH AN INSTALLATION

BACKGROUND OF THE INVENTION

The invention relates to a transport installation comprising a continuous running rope supporting vehicles arranged at intervals along the rope with a preset running rate, said installation having loading/unloading terminals arranged along the rope and comprising:

- detachment member, on entry to the terminal, that uncouples the vehicles from the rope,
- an attachment member, on exit from the terminal, that recouples the vehicles onto the rope,
- transfer circuit of the vehicles, with a slowing-down section equipped with a slowing-down device, a speeding-up section equipped with an accelerating device, connected by an intermediate section wherein the vehicles run at reduced or nil speed equipped with a driving device of the vehicles, and
- loading/unloading points in/from the vehicles, arranged along the intermediate section.

The invention also relates to a method for controlling such an installation.

STATE OF THE ART

Conventionally, the vehicles entering the loading/unloading terminals arrive with a running rate and the vehicles follow the same path along the transfer circuit. The vehicles run through the intermediate section at very low speed so as to enable loading and unloading of the passengers present at the loading and unloading points. The loading and unloading phases remain the most delicate in that the passenger or group of passengers presents a speed differential that has to be compensated in almost instantaneous manner. The operating personnel can provide assistance and has to check that loading and/or unloading takes place in satisfactory manner. Any loading and/or unloading problem of course has to be dealt with as quickly as possible in order not to aggravate the consequences thereof.

It has been observed that the number of operating personnel present is low, in compliance with regulations, but there is at least one operator per terminal. This limiting of the personnel is a general tendency which consists in optimizing the charges necessary for satisfactory operation of an installation but without any loss of safety.

To make the loading and unloading phases safe, while at the same time enabling full automation of the terminal if necessary, it has already been imagined to carry these phases out with the vehicles at a standstill. These installations enable persons with reduced mobility and children to embark in complete safety, and also enable the filling ratio of the vehicles to be optimized. But it is obvious that the waste of time generated by stopping the vehicles gives rise to a considerable decrease of the hourly capacity of the installation.

An installation of this type is described in the document FR2583363, in which the cars are grouped along the loading/unloading platform to form a group of a preset number of cars, and loading and unloading in and from the cars are authorized at the rate in which the cars arrive.

OBJECT OF THE INVENTION

The object of the invention consists in providing a rope transport installation that enhances passenger safety and comfort during the loading and unloading phases, while at the same time maintaining a high line capacity, and that is able to be automated if necessary.

According to the invention, this object is achieved by the fact that each loading/unloading terminal comprises:

- a grouping section of the vehicles, located between the slowing-down section and the intermediate section, equipped with means for forming groups of a preset number of vehicles, and first transfer means to move each group formed to the intermediate section for collective driving of said group by the driving device of the intermediate section,
- a separating section of the vehicles, located between the intermediate section and the speeding-up section, to collectively stock each group coming from the intermediate section, said separating section being equipped with second transfer means to selectively move the stocked vehicles to the speeding-up section for individual driving by the accelerating device of the speeding-up section at said preset running rate.

A transport installation according to the invention enables different operations to be carried out in parallel, at the same time, for all the vehicles of the group present in the intermediate section, i.e. the opening and closing times of the vehicle doors and the loading and unloading times. This arrangement enables the time available for these operations to be considerably increased, which is particularly interesting for loading and unloading, which is then substantially equal to multiplication of the usual available time by the preset number of vehicles forming a group. This time is the same for all the vehicles, which ensures a high line throughput rate. Passenger comfort and safety during the delicate loading and unloading phases are thereby improved and are equal whatever the vehicle of the group. These operations can even be performed with vehicles at a standstill without this having an adverse effect on the capacity of the installation. In this case, full automation of the terminals becomes easily achievable. Furthermore, loading in and unloading from the vehicles of a group are performed at the same time as formation of the next group, for a saving in time and therefore a gain in throughput.

The invention also relates to a method for controlling such an installation, wherein:

- the vehicles are grouped between the slowing-down section and the intermediate section to form groups of a preset number of vehicles,
- each group formed is transferred to the intermediate section for collective driving of said group by the driving device of the intermediate section,
- each group coming from the intermediate section is stocked collectively between the intermediate section and the speeding-up section,
- the stocked vehicles are selectively transferred to the speeding-up section for individual driving by the accelerating device of the speeding-up section at said preset running rate.

BRIEF DESCRIPTION OF THE DRAWINGS

Other advantages and features will become more clearly apparent from the following description of a particular embodiment of the invention given as a non-restrictive example only and represented in the accompanying drawings, in which.

DESCRIPTION OF A PREFERRED EMBODIMENT OF THE INVENTION

The invention will be described in application to a detachable gondola car transport installation. In order to understand the invention better in the following, the manner in which detachable gondola car transport installations with continuous driving along the aerial line operate conventionally is explained hereafter. It is nevertheless certain that the invention will be able to find its application in all rope transport installations supporting vehicles, i.e. in all types of detachable rope installations.

Figure 1:
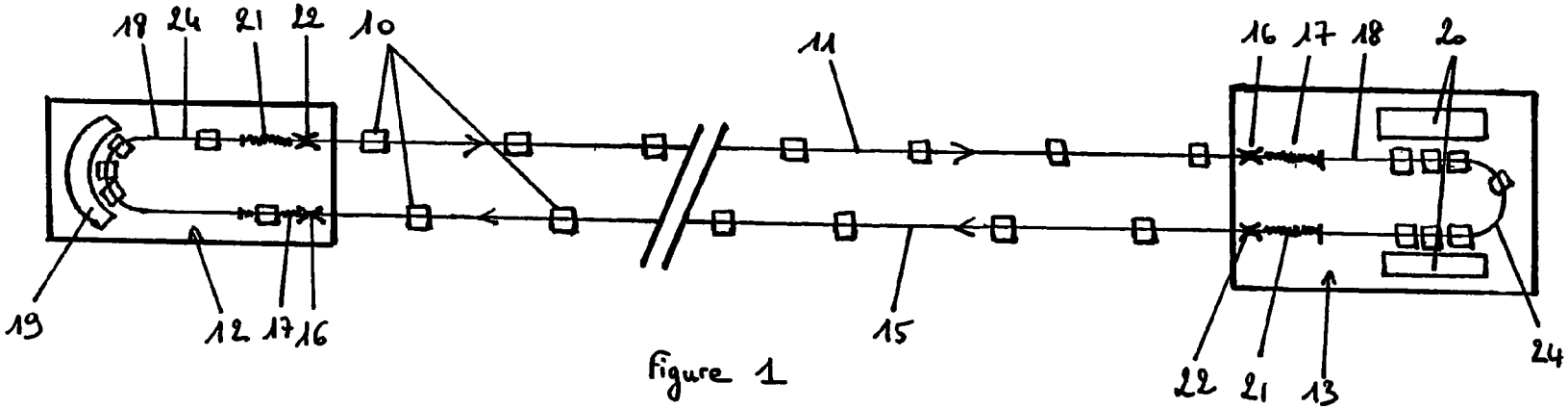
FIGS. 1 and 2 represent schematic views of a detachable transport installation with two sections.
Figure 2:
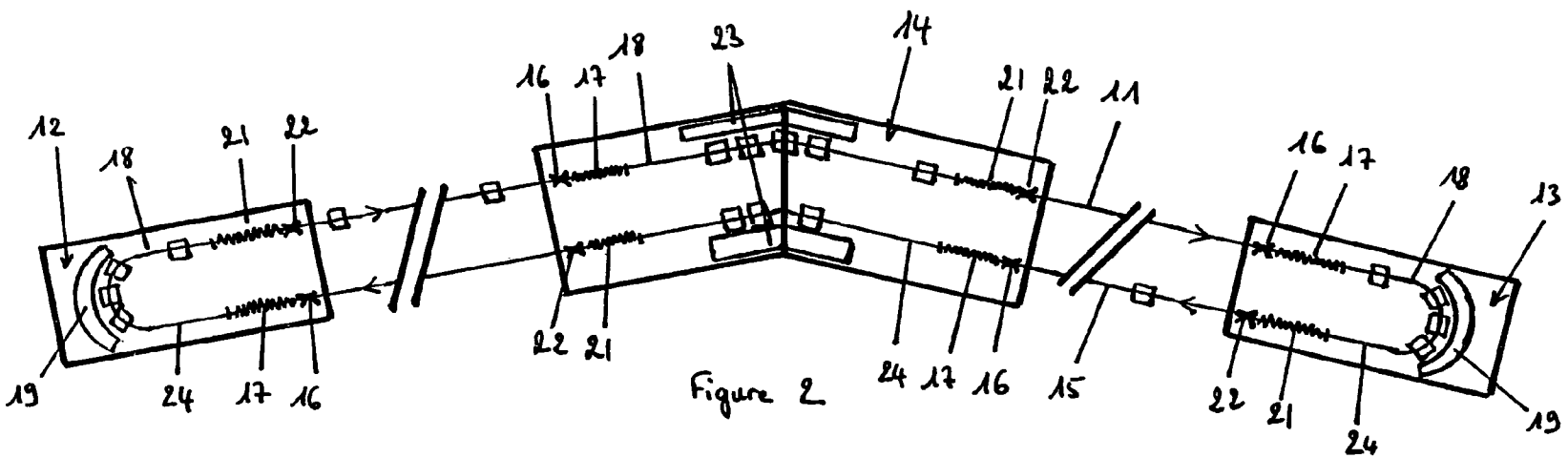

With reference to FIGS. 1 and 2, a plurality of vehicles 10, in this case cars, move on a looped line 11 from a first end terminal 12 to a second end terminal 13, may be with an intermediate terminal 14 (FIG. 2). The vehicles 10 come back in the opposite direction on another parallel line 15 by means of one or more driving and hauling rope(s) in the case of a gondola car, or any other line or traction means for other types of people movers.

Between the different terminals 12, 13, 14, the vehicles 10 move at high speed, for example at several meters per second, and are staggered in regulated manner at regular intervals, with low time intervals of about ten seconds.

At the entry to one of the end terminals 12, 13, the vehicles 10 are detached from the ropes by a detachment member 16 provided at the level of a detachment zone, and are then slowed down over a certain length over a slowing-down section 17. They then run at low speed along an intermediate section 18 having a curved shape making them run through a half-turn, and pass in front of the loading/unloading points 19, 20 situated, depending on the type of terminals, either in the curved part or in straight lateral parts.

At the end of their slow running, or even being stopping, phase in the intermediate section 18, the vehicles 10 are re-accelerated in a speeding-up section 21 and recoupled to the rope by an attachment member provided in an attachment zone on exit from the terminal 12, 13. The slowing-down section 17, intermediate section 18 and speeding-up section 21 form a transfer circuit 24 from the line 11 to the line 15.

In an intermediate terminal 14 (FIG. 2) through which the vehicles 10 run, loading/unloading points 23 extend laterally along the path of the vehicles 10 over the intermediate section 18. The vehicles are first detached from the rope as in the end terminals 12, 13, and then slowed down before passing in front of the points 23, and are then accelerated and attached.

FIGS. 3 to 6 illustrate an end terminal of an installation according to the invention, which is an adaptation of the installation of FIGS. 1 and 2. In the slowing-down section 17, a slowing-down device slows down the vehicles 10 detached from the rope, whereas on the speeding-up section 21, an accelerating device reaccelerates them to a speed equal to that of the rope to enable reattachment without jerking. The slowing-down and accelerating devices are both formed by a set of wheels 25 with pneumatic tires respectively staggered along the slowing-down section 17 and the speeding-up section 21, to cooperate by friction with a friction track borne by the grips of the vehicles 10. The wheels 25 are coupled by means of transmission belts 26 engaged on pulleys 27 mounted coaxially to the wheels 25. Each wheel 25 is securedly attached to two pulleys 27, each cooperating respectively with a belt 26, one of the belts 26 engaging on one of the pulleys 27 of one of the adjacent wheels 25 and the other of the belts 26 cooperating with one of the pulleys 27 of the other of the adjacent wheels 25. For driving, at least one of the wheels of each of the devices can be connected by means of a belt with a drive power take-off 28 derived from the rope or from its drive. Such devices are well known and do not need to be described in further detail.

The slowing-down section 17 and speeding-up section 21 are connected by the intermediate section 18 along which the vehicles 10 run at low speed by means of a driving device formed by sets of wheels 29 with pneumatic tires. All of the wheels 29 of the driving device are driven together, in the example, in the same way as the slowing-down and speeding-up devices, i.e. by pulleys 33 and belts 34. In other alternative embodiments, the wheels 29 of the curved sector (curved part of the intermediate section 18) are driven in synchronism together by idle pinions fitted between transmission pinions mounted coaxially to the wheels. Driving of the wheels 29 of the intermediate section 18 is performed by a variable speed motor 30 which drives a transmission belt 31 stretched between two auxiliary pulleys 32 one whereof is mounted coaxially to one of the pulleys 33. The structure of the driving device of the intermediate section 18 is such that reduction of the drive speed of the vehicles 10 to zero can be controlled.

Figure 3:
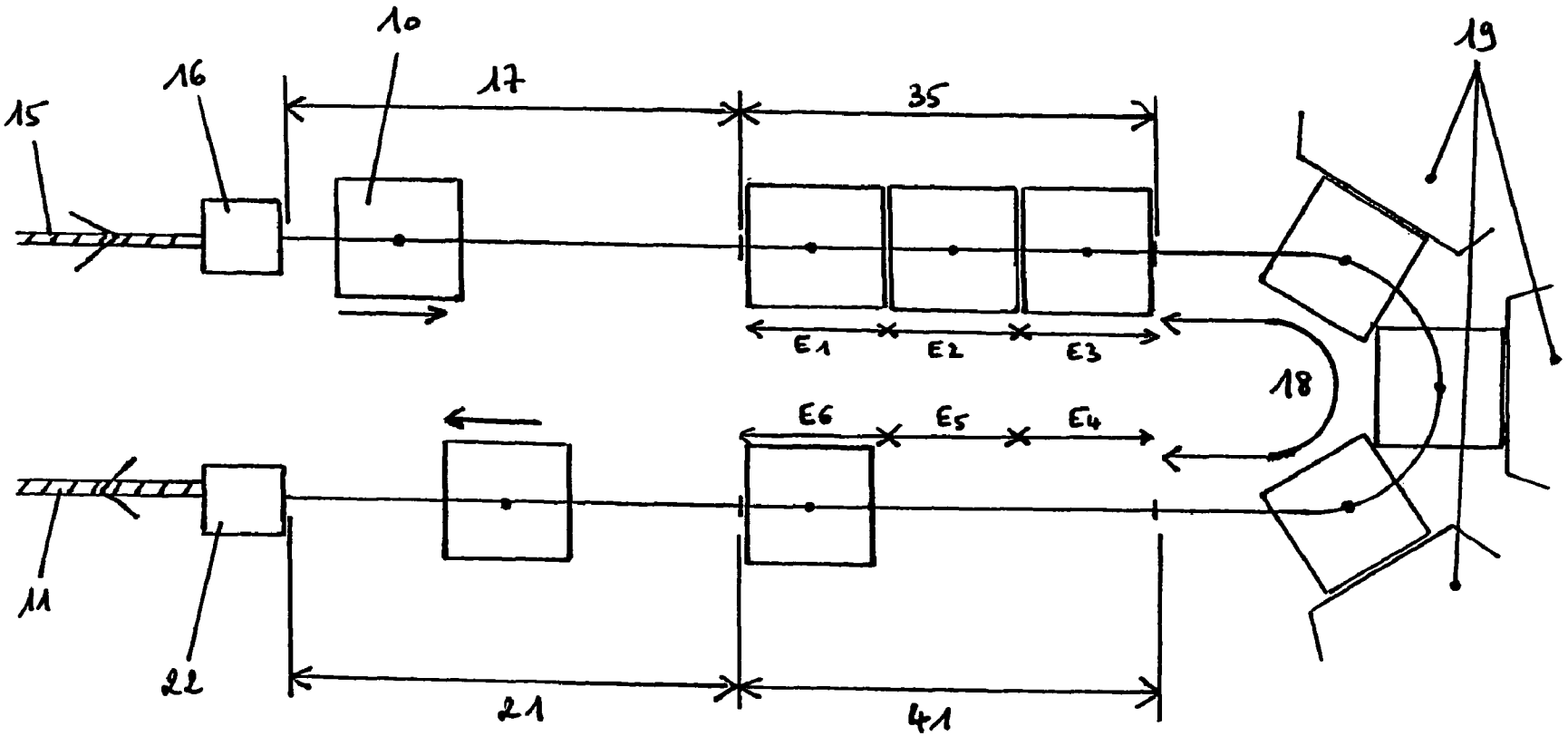
FIG. 3 shows a schematic view of a end terminal of a transport installation according to the invention.
Figure 4:
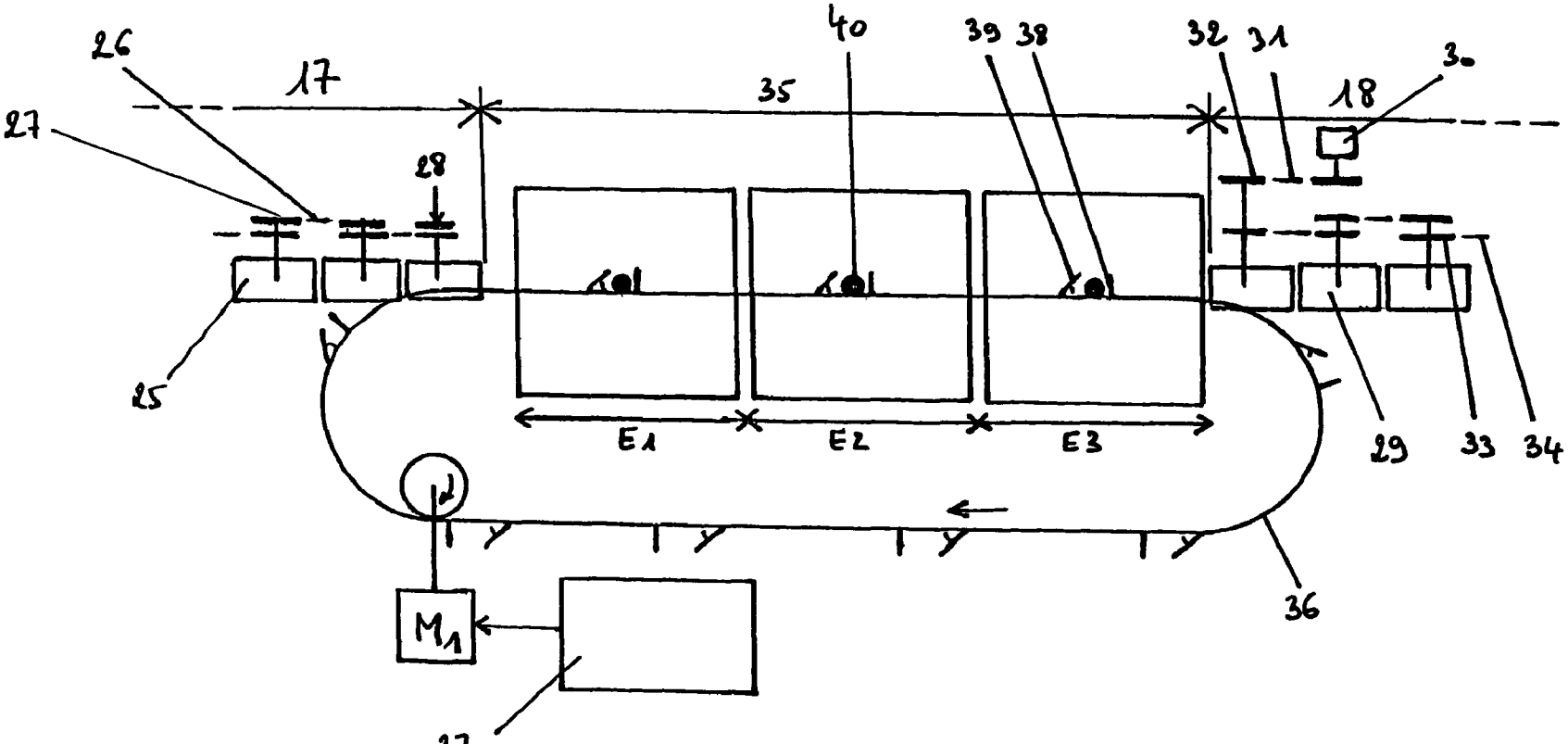
FIG. 4 is a detailed view of a first example of a grouping section according to the invention.

According to the invention and with reference to FIG. 3, a grouping section 35 of the vehicles 10 is arranged between the slowing-down section 17 and the intermediate section 18. FIG. 4 illustrates the constitution of a first example of a grouping section. A closed-loop strip 36, one branch whereof coincides with the expected direction of movement of the vehicles 10 along the grouping section 35, is driven unidirectionally by a variable speed motor M1 controlled by a control unit 37. The strip 36 presents external drive pegs that are alternately fixed and withdrawable in unidirectional manner, respectively 38 and 39. A pair composed of a fixed peg 38 and a withdrawable peg 39 is arranged along the external face of the strip 36 with a slightly larger pitch than the length of a vehicle 10 in the driving direction. The pegs 38, 39 of a pair are close to one another and enable a wedge 40, for example securedly attached to the detachable grip of the vehicle 10 in the example, to be inserted between them and secured. The length of the grouping section 35 is such that three vehicles 10 can be grouped in three successive and adjacent reception spaces E1, E2, E3.

According to the invention, a vehicle separating section 41 (FIG. 3) is arranged between the intermediate section 18 and the speeding-up section 21. The separating section 41 is equipped with a strip (not represented) similar to the strip 36.

Operation of the system is as follows. To start with, the reception spaces E1, E2, E3 of the grouping section are empty, i.e. exempt of vehicles 10. When a first vehicle comes from the slowing-down section 17, it comes and houses in the first reception space E1, i.e. the one which is adjacent to the slowing-down section 17. In the time interval preceding arrival of a second vehicle 10, said time interval being determined by the running rate of the installation, the motor M1 drives the strip 36 in the direction of the arrow indicated in FIG. 4 to position the first vehicle 10 in the reception space E2. The first reception space E1 being freed, the second vehicle 10 comes and houses in the first reception space E1. The operation is renewed for receipt of a third vehicle 10.

FIGS. 3 and 4 illustrate the installation when the three spaces E1, E2, E3 accommodate a vehicle 10. In the time interval preceding arrival of a new vehicle 10, the motor M1 is controlled by the control unit 37 to drive the strip 36 at high speed so as to transfer the group of three vehicles 10 present in the grouping section 35 to the intermediate section 18. In this movement, the vehicles 10 housed in the spaces E1, E2, E3 are transferred until they are taken up by friction by the wheels 29.

Thus, the grouping section 35 is equipped with means for forming groups of a preset number (here three) of vehicles 10, and with first transfer means to move each group formed to the intermediate section 18 for collective driving of the group by the driving device of the intermediate section 18. The variable speed motor 30 ensures controlled drive of the vehicles 10 of the transferred group so as to position each of them facing a respective loading/unloading point 19. The motor 30 then stops and the vehicles 10 remain at a standstill in this position.

In the meantime, a new group of vehicles 10 is formed in the grouping section 35 in the manner described above. The motor 30 is commanded at the moment where said new group is transferred by the strip 36 so as to remove the vehicles 10 of the first group to the separating section 41 in which they are stocked collectively in reception spaces E4, E5, E6. In this movement of the vehicles 10, the strip of the separating section 41 operates in the same way as the strip 36 during filling of the reception spaces E1, E2, E3.

The motor of the strip of the separating section 41 is then commanded so as to move the vehicles 10 selectively to the speeding-up section 21 for individual driving by the wheels of the accelerating device at the preset running rate of the installation. Transfer of a vehicle 10 to the speeding-up section 21 is accompanied by a movement of the strip of the separating section 41 enabling the reception space E6 adjacent to the speeding-up section to be filled.

Figure 5:
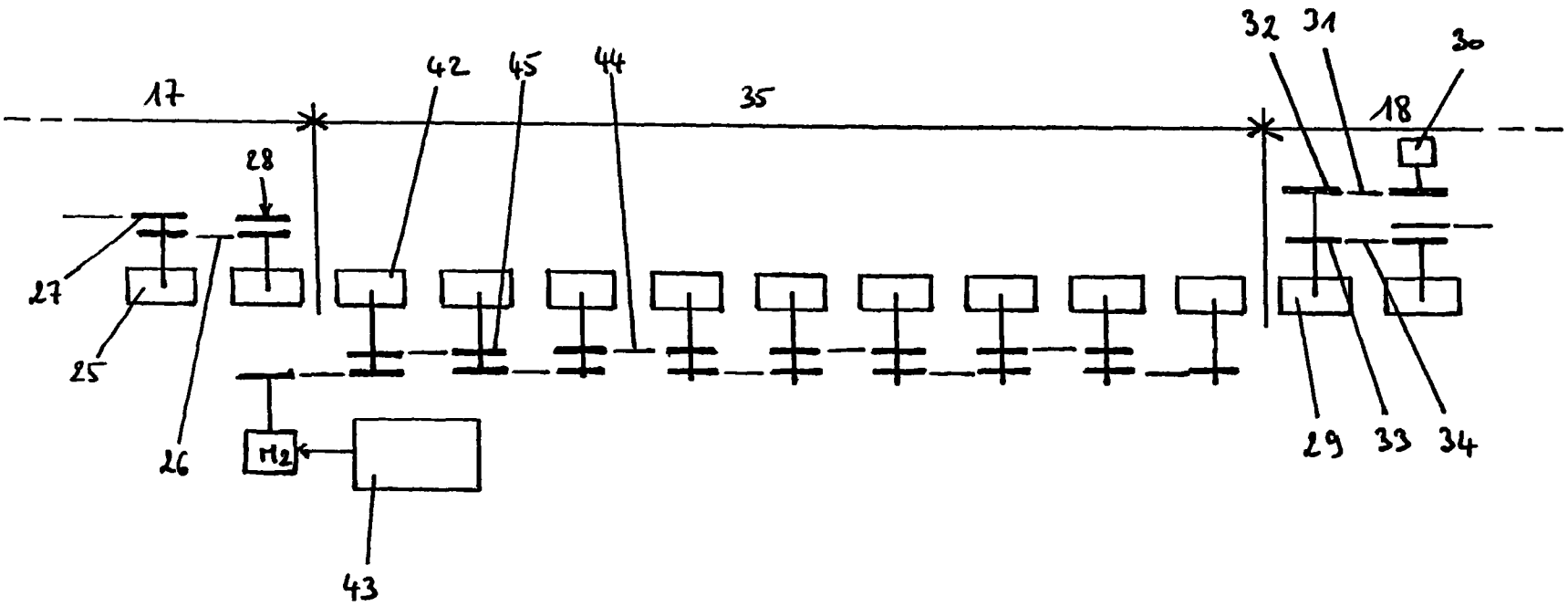
FIG. 5 is a detailed view of a second example of a grouping section according to the invention.

In other alternative embodiments of the invention and with reference to FIG. 5, the grouping section 35 comprises a set of wheels 42 with pneumatic tires driving the vehicles 10 by friction. A variable speed motor M2 controlled by a control unit 43 drives the set of wheels 42 in synchronism by means of transmission belts 44 and pulleys 45. More precisely, the wheels 42 are coupled by means of the belts 44 which are engaged on the pulleys 45 mounted coaxially to the wheels 42. Each wheel 42 is securedly attached to two pulleys 45, each cooperating respectively with a belt 44, one of the belts 44 engaging on one of the pulleys 45 of one of the adjacent wheels 42 and the other of the belts 44 cooperating with one of the pulleys 45 of the other of the adjacent wheels 42. Operation of this alternative embodiment of the grouping section 35 is similar to that of the section comprising the strip 36. This technology can moreover be applied for achieving the separating section 41.

Figure 6:
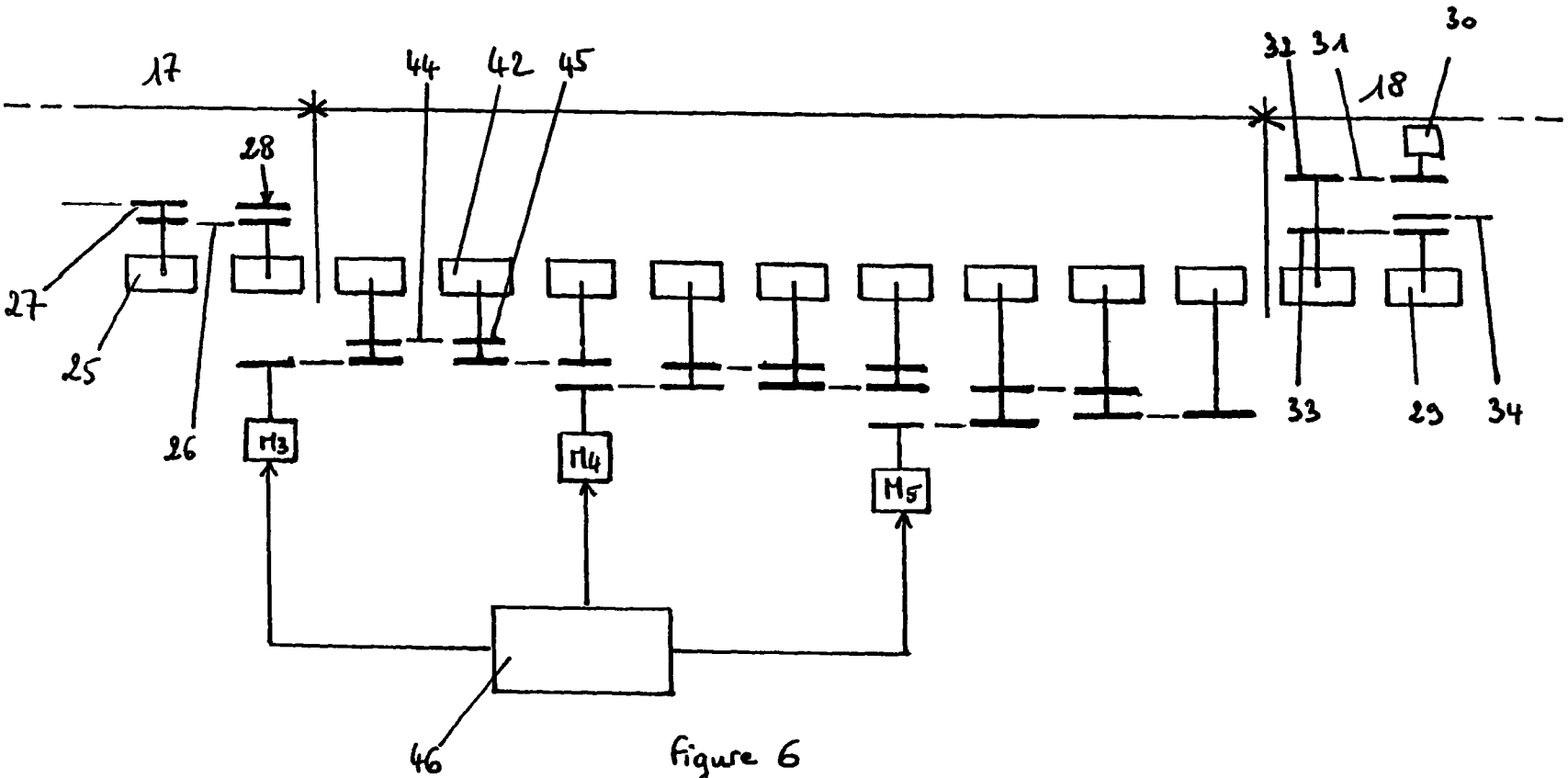
FIG. 6 is a detailed view of a third example of a grouping section according to the invention.

In an alternative embodiment and with reference to FIG. 6, the set of wheels 42 is subdivided into three successive sections of three wheels 42. Each section is driven individually by distinct variable speed motors M3 to M5 controlled by a control unit 46. Each section coincides, in the direction of movement of the vehicles 10, with a reception space E1, E2, E3. When a first vehicle comes from the slowing-down section 17 to form a group, it comes and houses in the last reception space E3, i.e. the one that is adjacent to the intermediate section 18, due to suitable control of the motors M3 to M5 by the control unit 46. The motor M5 is shut down, unlike the motors M3 and M4. In the time interval preceding arrival of a second vehicle 10, the control unit 46 stops the motor M4. The second vehicle 10 then comes and houses in the second reception space E2. When the group of vehicles 10 has been formed, the control unit 46 starts the motors M3 to M5 simultaneously. It is clear that the number of successive sections can vary without departing from the scope of the invention. This technology can be applied for achieving the separating section 41.

In general manner, the preset number of vehicles 10 per group that the grouping section 35 is designed to form can vary according to the applications, according to the capacity of the installation, according to the permitted length of the loading/unloading point, etc.

In preferred alternative embodiments of the invention, the control units 37, 43 and 46 of the motors M1 to M5 will also control the variable speed motor 30 of the driving device of the intermediate section 18.

Figure 7:
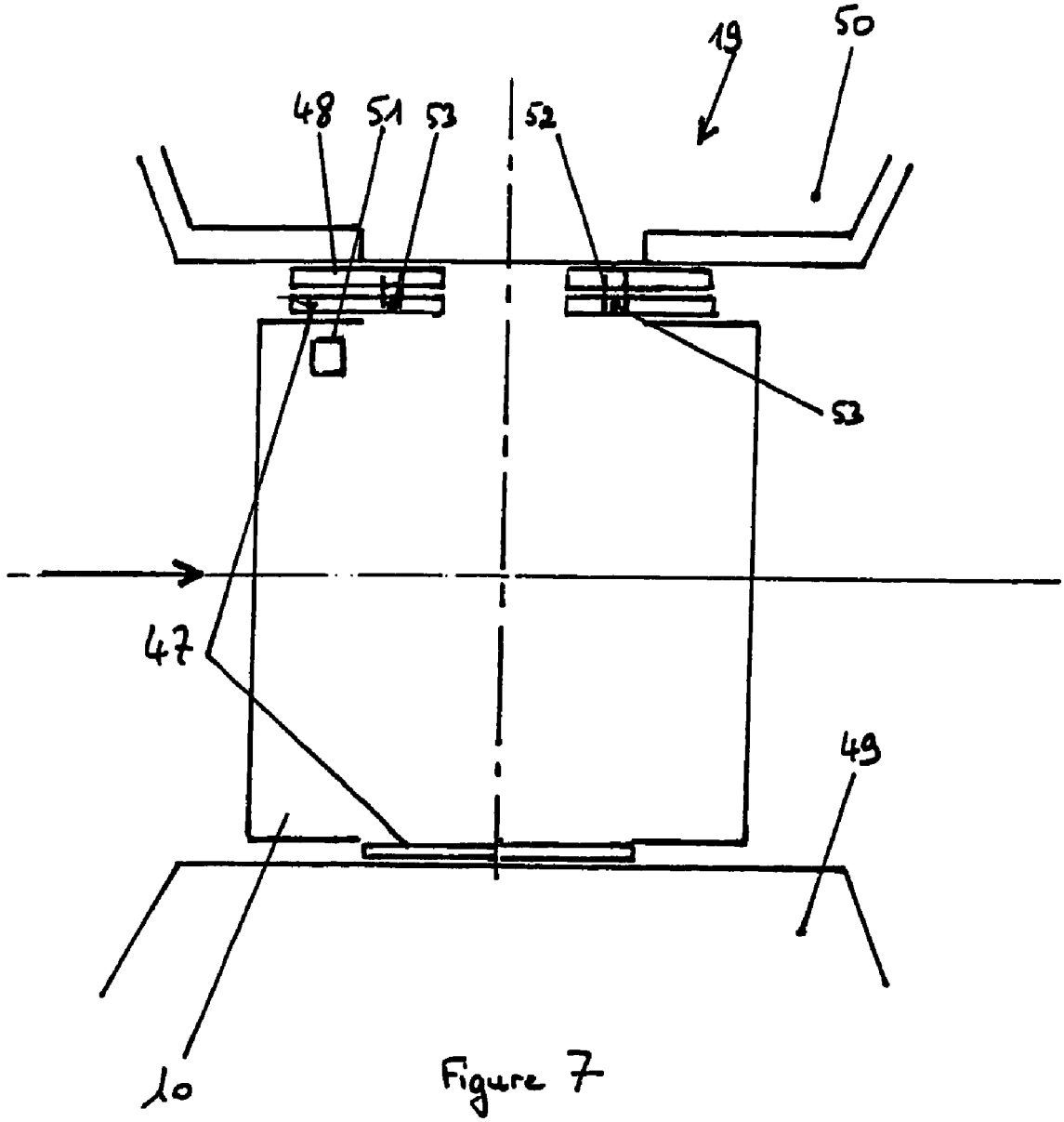
FIG. 7 is an elevation view of a loading/unloading point equipped with sliding doors.

As illustrated in FIG. 7, loading/unloading of passengers advantageously takes place at a standstill, each vehicle 10 stopping at the corresponding loading/unloading point 19, and is controlled by sliding center parting doors 47, 48, one 47 being integrated in each vehicle 10 and the other 48 being arranged on the point 19 so as to face the door 47. Opening and closing of the doors 47 of the vehicles 10 and of the sliding loading/unloading point door 48 are automatic and simultaneous. Any mechanism, mechanical or otherwise, enabling this result to be achieved can be used.

In certain alternative embodiments, each vehicle 10 comprises in-board actuating means 51, with power supply in the terminal, for automatic opening and closing of the doors 47. In other alternative embodiments, the loading/unloading point doors 48 comprise a drive mechanism 52 such as retractable transverse fingers, of a device 53 securedly attached to the doors 47 of the vehicles 10, such as for example a salient pin above the doors 47, for a movement of a loading/unloading point door 48 to actuate an identical movement of the facing door 47 of the corresponding vehicle 10.

Furthermore, each loading/unloading point 19 comprises a distinct unloading place 49 and loading place 50 arranged symmetrically with respect to the path of the vehicles 10. Each vehicle 10 then comprises two corresponding opposite doors 47.

The invention claimed is:

1. Transport installation comprising a continuous running rope supporting vehicles arranged at intervals along the rope with a preset running rate, said installation having loading/unloading terminals arranged along the rope and comprising:

a detachment member, on entry to the terminal, that uncouples the vehicles from the rope;

an attachment member, on exit from the terminal, that recouples the vehicles and the rope;

a transfer circuit of the vehicles, with a slowing-down section equipped with a slowing-down device, a speeding-up section equipped with an accelerating device, connected by an intermediate section wherein the vehicles run at reduced or nil speed equipped with a driving device of the vehicles; and loading/unloading points in/from the vehicles, arranged along the intermediate section, wherein each loading/unloading terminal comprises:

a grouping section of the vehicles, located between the slowing-down section and the intermediate section, equipped with means for forming groups of a preset number of vehicles, and first transfer means for collectively driving said group to collectively move each group formed to the intermediate section for collective driving of said group by the driving device of the intermediate section; and a separating section of the vehicles, located between the intermediate section and the speeding-up section, to collectively stock each group coming from the intermediate section, said separating section being equipped with second transfer means to selectively move the stocked vehicles to the speeding-up section for individual driving by the accelerating device of the speeding-up section at said preset running rate.

2. Installation according to claim 1, wherein the grouping section comprises a closed-loop strip driven unidirectionally by a variable speed motor controlled by a control unit and presenting external drive pegs that are alternately fixed and retractable in unidirectional manner.

3. Installation according to claim 1, wherein the grouping section comprises a set of wheels with pneumatic tires driving the vehicles by friction.

4. Installation according to claim 3, comprising a variable speed motor driving the set of wheels and controlled by a control unit.

5. Installation according to claim 3, wherein the set of wheels is subdivided into several successive sections driven individually by distinct variable speed motors controlled by a control unit.

6. Installation according to claim 1, wherein the separating section comprises a closed-loop strip driven unidirectionally by a variable speed motor controlled by a control unit and presenting external drive pegs that are alternately fixed and retractable in unidirectional manner.

7. Installation according to claim 1, wherein the separating section comprises a set of wheels with pneumatic tires driving the vehicles by friction.

8. Installation according to claim 7, comprising a variable speed motor driving the set of wheels and controlled by a control unit.

9. Installation according to claim 7, wherein the set of wheels is subdivided into several successive sections driven individually by distinct variable speed motors controlled by a control unit.

10. Installation according to claim 1, wherein passenger loading/unloading takes place at a standstill, each vehicle stopping at the corresponding loading/unloading point, which comprises a sliding loading/unloading point door arranged facing a door of the vehicle at a standstill.

11. Installation according to claim 10, wherein opening and closing of the vehicle doors and of the loading/unloading point doors are automatic and simultaneous.

12. Installation according to claim 11, wherein each vehicle comprises in-board actuating means, with power supplied in the terminal, for automatic opening and closing of the door of said vehicle.

13. Installation according to claim 11, wherein the loading/unloading point doors comprise a drive mechanism of a device securedly attached to the vehicle doors so that a movement of a loading/unloading point door actuates identical movement of the facing door of the corresponding vehicle.

14. Installation according to claim 1, wherein each loading/unloading point comprises a distinct unloading place and loading place arranged symmetrically with respect to the path of the vehicles, each vehicle having two corresponding opposite doors.

15. Method for controlling a transport installation comprising a continuous running rope supporting vehicles arranged at intervals along the rope with a preset running rate, the installation having loading/unloading terminals arranged along the rope, comprising:

grouping vehicles between a slowing-down section and an intermediate section of the terminal to form groups of a preset number of vehicles;

transferring each formed group collectively to the intermediate section for collective driving of said group a driving device of the intermediate section;

collectively stocking each group coming from the intermediate section between the intermediate section and a speeding up section of the terminal; and selectively transferring the stocked vehicles to the speeding-up section for individual driving by an accelerating device of the speeding-up section of the terminal at said preset running rate of the rope.

* * * * *